US006482019B1

(12) United States Patent
Lo Forte et al.

(10) Patent No.: US 6,482,019 B1
(45) Date of Patent: Nov. 19, 2002

(54) RETRACTING MODULAR JACK FOR PORTABLE APPLIANCE CONNECTIONS

(75) Inventors: Steven Lo Forte, Midvale, UT (US); Brent Madsen, Providence, UT (US); David Oliphant, West Valley City, UT (US)

(73) Assignee: 3Com Corporation, Santa Clara, CA (US)

( * ) Notice: Subject to any disclaimer, the term of this patent is extended or adjusted under 35 U.S.C. 154(b) by 49 days.

(21) Appl. No.: 09/687,016

(22) Filed: Oct. 13, 2000

(51) Int. Cl.[7] ..... H01R 9/09
(52) U.S. Cl. ..... 439/131; 439/676; 439/329
(58) Field of Search ..... 439/131, 676, 439/329, 344, 136, 142, 144; 361/683, 684

(56) References Cited

U.S. PATENT DOCUMENTS

| | | | | |
|---|---|---|---|---|
| 2,916,720 A | | 12/1959 | Steans | 339/91 |
| 4,186,988 A | | 2/1980 | Kobler | 339/176 MP |
| 4,241,974 A | | 12/1980 | Hardesty | 339/154 A |
| 4,303,296 A | | 12/1981 | Spaulding | 339/122 R |
| 4,352,492 A | | 10/1982 | Smith | 273/1 GC |
| 4,407,559 A | | 10/1983 | Meyer | 339/126 R |
| 4,428,636 A | | 1/1984 | Kam et al. | 339/97 P |
| 4,710,136 A | | 12/1987 | Suzuki | 439/374 |
| 4,778,410 A | | 10/1988 | Tanaka | 439/676 |
| 4,915,648 A | | 4/1990 | Takase et al. | 439/490 |
| 5,035,641 A | | 7/1991 | Van-Santbrink et al. | 439/329 |
| 5,051,099 A | | 9/1991 | Pickles et al. | 439/108 |
| 5,139,439 A | | 8/1992 | Shie | 439/359 |
| 5,183,404 A | | 2/1993 | Aldous et al. | 439/55 |
| 5,184,282 A | | 2/1993 | Kaneda et al. | 361/395 |
| 5,336,099 A | | 8/1994 | Aldous et al. | 439/131 |
| 5,338,210 A | | 8/1994 | Beckham et al. | 439/131 |
| 5,385,479 A | * | 1/1995 | Okada | 439/144 |
| 5,391,094 A | | 2/1995 | Kakinoki et al. | 439/638 |
| 5,411,405 A | | 5/1995 | McDaniels et al. | 439/131 |
| 5,481,616 A | | 1/1996 | Freadman | 381/90 |
| 5,499,923 A | | 3/1996 | Archibald et al. | 439/26 |
| 5,505,633 A | | 4/1996 | Broadbent | 439/329 |
| 5,509,811 A | | 4/1996 | Homic | 439/55 |
| 5,538,442 A | | 7/1996 | Okada | 439/676 |
| 5,547,401 A | | 8/1996 | Aldous et al. | 439/676 |
| 5,561,727 A | | 10/1996 | Akita et al. | 385/88 |
| 5,562,504 A | | 10/1996 | Moshayedi | 439/638 |
| 5,608,607 A | | 3/1997 | Dittmer | 361/686 |
| 5,634,802 A | | 6/1997 | Kerklaan | 439/131 |
| 5,660,568 A | | 8/1997 | Moshayedi | 439/654 |
| 5,664,955 A | * | 9/1997 | Arnett | 439/135 |
| 5,667,390 A | | 9/1997 | Keng | 439/76.1 |
| 5,667,395 A | | 9/1997 | Okada et al. | 439/131 |
| 5,679,013 A | | 10/1997 | Matsunaga et al. | 439/144 |
| 5,727,972 A | | 3/1998 | Aldous et al. | 439/655 |
| 5,773,332 A | | 6/1998 | Glad | 439/344 |
| 5,797,771 A | | 8/1998 | Garside | 439/610 |
| 5,816,832 A | | 10/1998 | Aldous et al. | 439/131 |

FOREIGN PATENT DOCUMENTS

| | | |
|---|---|---|
| JP | 58-34370 | 5/1983 |
| JP | 61-256850 | 11/1986 |
| WO | WO 95/13633 | 5/1995 |

OTHER PUBLICATIONS

IBM Technical Disclosure Bulletin, "Electrical Connector For Flat Flexible Cable," vol. 25, No. 1, Jun. 1982.

* cited by examiner

*Primary Examiner*—P. Austin Bradley
*Assistant Examiner*—Alexander Gilman
(74) *Attorney, Agent, or Firm*—Workman, Nydegger & Seeley

(57) ABSTRACT

A modular jack, for coupling with a physical/electrical media plug, comprises a frame, a rocker arm, electrical contacts, and a retractable cover guard for protecting the electrical contacts during nonuse. The retractable cover guard moves from a protective position to a retracted position when a physical/electrical media plug is inserted into the modular jack and returns to the protective position when the physical/electrical media plug is removed. While only a shallow insertion depth of the physical/electrical media plug is permitted, the rocker arm aligns and mechanically secures the physical/electrical media plug within the modular jack.

38 Claims, 9 Drawing Sheets

RETRACTING MODULAR JACK FOR PORTABLE APPLIANCE CONNECTIONS

RELATED APPLICATIONS

This application is related to copending application Serial No. 09/687,129 entitled "Low Profile Connector with Extending Latch Mechanism" filed concurrently herewith and commonly assigned with the present invention, and incorporated herein by reference.

BACKGROUND OF THE INVENTION

1. The Field of the Invention

The present invention relates to electrical interface connections. More particularly, it relates to modular jacks configured to couple with physical/electrical media plugs.

2. The Relevant Technology

It is well recognized that the computer industry is experiencing tremendous growth, driven in large part by a demand for immediate access to information. To meet this demand the industry has developed a wide assortment of electrical apparatus to transmit and receive electronically retrievable data. Electrical apparatus include, but are not limited to laptops, notebook computers, palmtops, and PDAs. Although there are numerous public and private networks and databases that provide electronically retrievable data, absent the ability to connect directly with a network, one is relegated to relying upon the exchange of discs or tapes in order to receive the data that is accessible through the network.

The ability to freely access data on a network and to transfer information between electrical apparatus can dramatically increase productivity and reduce overall production time. Accordingly, electrical apparatus have been equipped with means to access electronically retrievable data over networks, such as the Internet, a world wide network, local area networks ("LANs") and wide area networks ("WANs").

The transfer of data over a network can be accomplished with wireless technology or by telephone lines and cables. The interface between a computer and a cable or telephone line is typically accomplished through a media connector.

One conventional type of media connector is the Registered Jack connector (RJ-series connector). RJ-series connectors are used by almost all telephone companies throughout the world for many applications, the most important of which is interconnection of telephones with telephone lines. For this reason, stringent standardization of connectors has been established to enable compatibility and interactivity. Due to the simplicity of the connection and the established standards, RJ-series connectors are used extensively in the computer industries and in other industries where communication over telephone lines or other types of cables is required.

RJ-series connectors include a plug or contact block and a receptacle or socket. The plug comprises a small block shaped body coupled with a cable, such as a telephone line. Housed within the body are several contact pins. Each of the contact pins is attached to a discrete wire within the cable. Mounted on the outside of the body is a flexible retention clip that is used for removably securing the plug within the socket of an electrical apparatus.

The socket is typically formed on the side of the electrical apparatus and is configured to receive the plug. Disposed within the socket are electrical contact wires. During use, the contact wires within the socket are biased against corresponding contacts on a plug to complete an electrical connection between the plug and the electrical apparatus.

The interior surface of the socket comprises a latching mechanism that receives the retention clip of the plug so as to mechanically secure the plug within the socket by holding retention notches of the retention clip. To remove the plug, the retention clip is manually flexed towards the body of the plug to release the hold of the latching mechanism on the retention notches, thereby enabling manual removal of the plug from the socket.

Although RJ-type connectors are used extensively, they have several shortcomings. Most notably, the achievements in microprocessing have enabled manufactures to dramatically downsize various electrical apparatus. For example, mobile telephones and PDA's now exist that can easily fit in a shirt pocket. Such apparatus, however, are limited from further downsizing, in part, by the size of the socket in which the media plug is received. That is, to enable an electrical apparatus to house a standard sized socket having a defined depth, the electrical apparatus must have at least the same depth.

Besides limiting the size of an electrical apparatus, a full sized socket housed within an electrical apparatus occupies valuable space. Even in larger apparatus it is desirable to optimize the use of space so as to minimize size. When an electrical apparatus does not need to couple with a plug, the space occupied by the coupling socket is wasted. Accordingly, it would be desirable to provide a connector that minimizes the depth that is required for a media plug to be inserted into a socket while successfully coupling with an electrical apparatus.

Another problem encountered by traditional full sized sockets occurs when the socket is not occupied by a media plug and is left open to the environment. The problem is that the socket becomes a sink for dust and debris, preventing the contact pins of a media plug from biasing against the electrical contacts of the socket, ultimately preventing the media plug from interfacing with the electrical apparatus. Debris and exposure to the environment can also cause damage to the electrical contact wires. One solution to these problems is to cap the socket with a plug during nonuse to keep ancillary dust and debris from accumulating in the socket and on the electrical contact wires. However, this solution has its own problems. In particular, plugs can be misplaced and additional handling is required to remove and replace the cap during use and nonuse. Accordingly, it would be desirable to provide a connector having a cover that would protect the connector socket when not in use and would automatically articulate away from the connector socket when a media plug enters the connector socket.

Yet another problem encountered by traditional sockets is that they cannot securely accommodate both RJ-11 series plugs and RJ-45 series plugs. In particular, the size of the socket must be at least as wide as the body of an RJ-45 series plug, which is slightly wider than the body of an RJ-11 series plug. The RJ-45 series plug is wider than the RJ-11 series plug because it houses 8 contact wires whereas the RJ-11 houses either 4 or 6 contact wires. Accordingly, a socket that is configured to accommodate an RJ-11 series plug is too narrow to receive an RJ-45 series plug. Whereas a socket that is configured to receive an RJ-45 series plug is too wide to securely couple with an RJ-11 series plug because the space between the socket walls and the body of the plug allows the plug to wiggle back and forth.

Typically, RJ-11 series plugs are used as an interface to connect electrical apparatus to the Internet or for standard modem applications using normal telephone lines. RJ-45 series plugs are typically used as an interface to connect electrical apparatus onto LANs, particularly Ethernets. It is not uncommon for a single electronic apparatus to be used to connect to both the Internet and a LAN. Accordingly, it would be desirable to provide a connector that can securely accommodate both types of RJ-series media plugs so that an electronic apparatus may only require a single RJ-series connector.

BRIEF SUMMARY OF THE INVENTION

A modular jack is provided for coupling with RJ-series media plugs. The RJ-series media plug comprises a small block shaped body coupled with a cable, such as a telephone line. A flexible retention clip is mounted to the body of the plug and protrudes away from the body at a slight angle, terminating at a narrow free end. The retention clip has retention notches that define the edges where the retention clip significantly narrows. Housed within the plug body are distinct contact pins. Each of the contact pins are attached to discrete wires within the cable.

The modular jack comprises a frame, a rocker arm, electrical contacts, and a retractable cover guard. The frame has a aperture and a floor. The aperture extends from a top side of the frame to the floor and is configured to receive the body of the RJ-series media plug. The floor is configured to limit the insertion depth of the RJ-series media plug and to prevent the body of the RJ-series media plug from passing completely through the aperture of the frame. A plurality of electrical contacts are housed within the modular jack and are configured to bias against the contact pins of the RJ-series media plug when the body of the RJ-series media plug is received within the aperture of the frame. This effectuates the interface between the media plug and the electrical apparatus. The electrical contacts are exposed to the aperture of the frame but do not extend into the aperture.

During use, an RJ-series media plug is inserted into the aperture of the modular jack, causing a contact force to be applied to the retractable cover guard and to the base of the rocker arm. Upon receiving this contact force, the rocker arm pivots from a first position to a second position. In the first position, alignment arms of the rocker arm are substantially parallel to the top of the frame. In the second position, the alignment arms are substantially perpendicular to the frame and slidably engage the retention clip of the media plug. This aligns the body of the plug within the aperture of the frame, irrespective of the width of the media plug. The insertion depth of the media plug is shallow and is limited by the floor of the frame. The rocker arm physically secures and aligns the media plug within the socket of the modular jack when locking ears of the rocker arm latch onto the retention notches of the retention clip and when the alignment arms slidably engage the retention clip.

The retractable cover guard, upon receiving the contact force from the media plug, moves from a first position to a second position. The first position is a protective position in which the retractable cover guard covers the aperture of the frame and protects the electrical contacts of the modular jack during nonuse. In certain embodiments, the retractable cover guard also covers and protects the rocker arm. The retractable cover guard keeps dust and debris from settling in the aperture and on the electrical contacts during nonuse and also provides an aesthetic surface for displaying printed information, such as icons. When the retractable cover guard is moved into the retracted position, the aperture of the frame and the electrical contacts are exposed, enabling the media plug to be inserted and coupled with the modular jack.

There are several embodiments of the retractable cover guard of the present invention, each having a different mode of retracting from the protective position to the retracted position. In one embodiment the retractable cover guard is retractably attached to the floor of the frame. By way of example and not limitation, the means for attaching the retractable cover guard to the floor is a compression spring that constantly urges the retractable cover guard into the protective position. When a media plug is coupled with the modular jack of this embodiment, the retractable cover guard is forced downward to the floor, compressing the spring. When the media plug is removed, the compressed spring automatically returns the retractable cover guard back to the protective position.

In another embodiment the retractable cover guard is pivotally attached to the base of the rocker arm and extends across the aperture of the frame. In this embodiment, when the rocker arm pivots from a first position to a second position, the retractable cover guard engages the floor of the aperture, causing the retractable cover guard to pivot and slide across the floor into the retracted position. In the retracted position, the retractable cover guard rests against the floor and engages the body of the media plug. This limits the insertion depth of the media plug by preventing the body of the media plug from passing completely through the floor. After use, the rocker arm and retractable cover guard are returned to their previous positions, either automatically or manually.

In another embodiment the retractable cover guard is slidably attached to the top side of the frame. In this embodiment the retractable cover guard covers the aperture of the frame and the rocker arm. Before a media plug is inserted, the retractable cover guard is manually slid away from the aperture and the rocker arm, enabling the media plug to be inserted into the aperture. After use, when the media plug is removed, the retractable cover guard is slid back into its protective position either manually or automatically.

In another embodiment, the retractable cover guard is pivotally attached to the top side of the frame and covers the entire aperture and the rocker arm. In this embodiment, the retractable cover guard is manually pivoted up and away from the aperture prior to inserting a media plug into the aperture. The retractable cover guard can be attached to various portions and sides of the frame.

In yet another embodiment, the retractable cover guard arm is pivotally attached to the top side of the frame yet covers only the aperture and is automatically retracted into the aperture when a media plug engages the modular jack. The retractable cover guard can be either a single door or multiple doors to facilitate the retraction of the doors when the media plug is inserted into the aperture. The retractable cover guard is automatically returned to its protective position when the media plug is removed from the aperture.

One of the benefits of the present invention is that it provides a retractable cover guard that protects the aperture and electrical contacts of a modular jack during nonuse and requires only minimal handling when coupling with a media plug. Other benefits include providing a modular jack that is capable of securely coupling with both RJ-11 series plugs and RJ-45 series plugs, while requiring only a shallow insertion depth of the media plugs.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention relates to modular jacks for coupling electrical apparatus with physical/electrical media plugs.

The modular jack of the present invention is configured to electrically and mechanically couple with a corresponding physical/electrical media plug, hereinafter "media plug." Examples of media plugs include, but are not limited to, RJ-11 and RJ-45 series plugs.

In many of the depicted examples, the inventive modular jack is configured to receive RJ-series plugs. However, it should be appreciated that the present invention contemplates that it would be obvious to one skilled in the art based on the present disclosure to modify the depicted modular jack to receive other types of media plugs including non-standard plugs and media plugs that are developed or standardized in the future.

The term "electrical apparatus," as used in the specification and appended claims, is broadly intended to include any apparatus having electrical components. By way of example and not limitation, some of the more conventional electrical apparatus include: network computers, laptop computers, personal computers, notebook computers, palm top computers, PDA's, and modems. Non-conventional electrical apparatus can include, among other things, televisions, stereo equipment, other electrical musical devices, electrical tools, electrical appliances, and automobiles.

Figure 1:
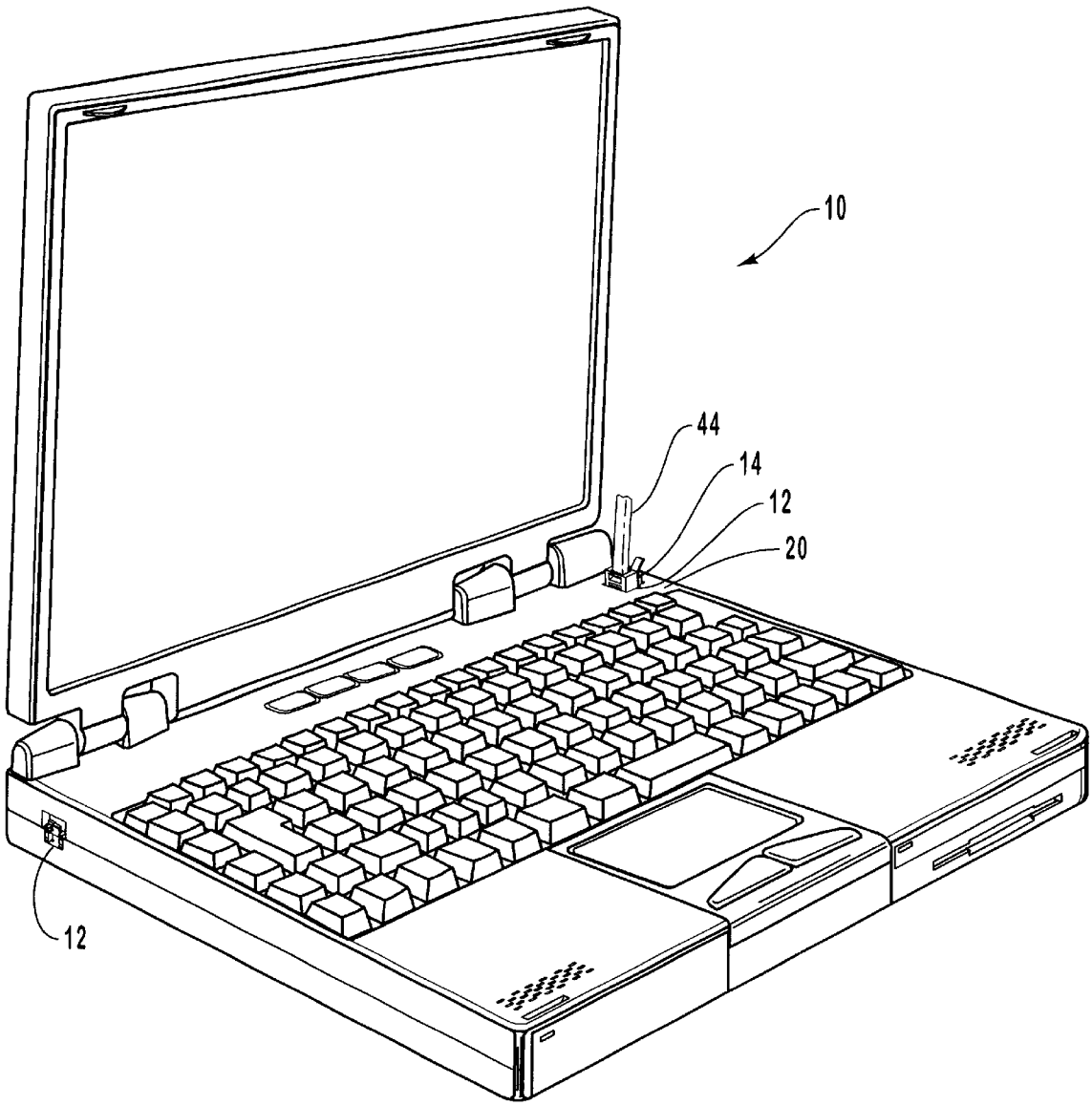
FIG. 1 is a perspective view of an electrical apparatus that includes two modular jacks of the present invention.

Depicted in FIG. 1 is one embodiment of an electrical apparatus 10 that includes two modular jacks 12 of the present invention. As shown, and as will be described throughout, the modular jack 12 is configured to couple with a media plug 14. The modular jack 12 is integrally connected to the electrical apparatus 10 and may be located in various positions. Two possible positions are illustrated by way of example and not limitation. It is not necessary that an electrical apparatus 10 have two modular jacks 12. Rather, as will be described below, the modular jack 12 of the present invention accommodates different sized media plugs 14 so that an electrical apparatus 10 may only require a single modular jack 12.

Figure 2:
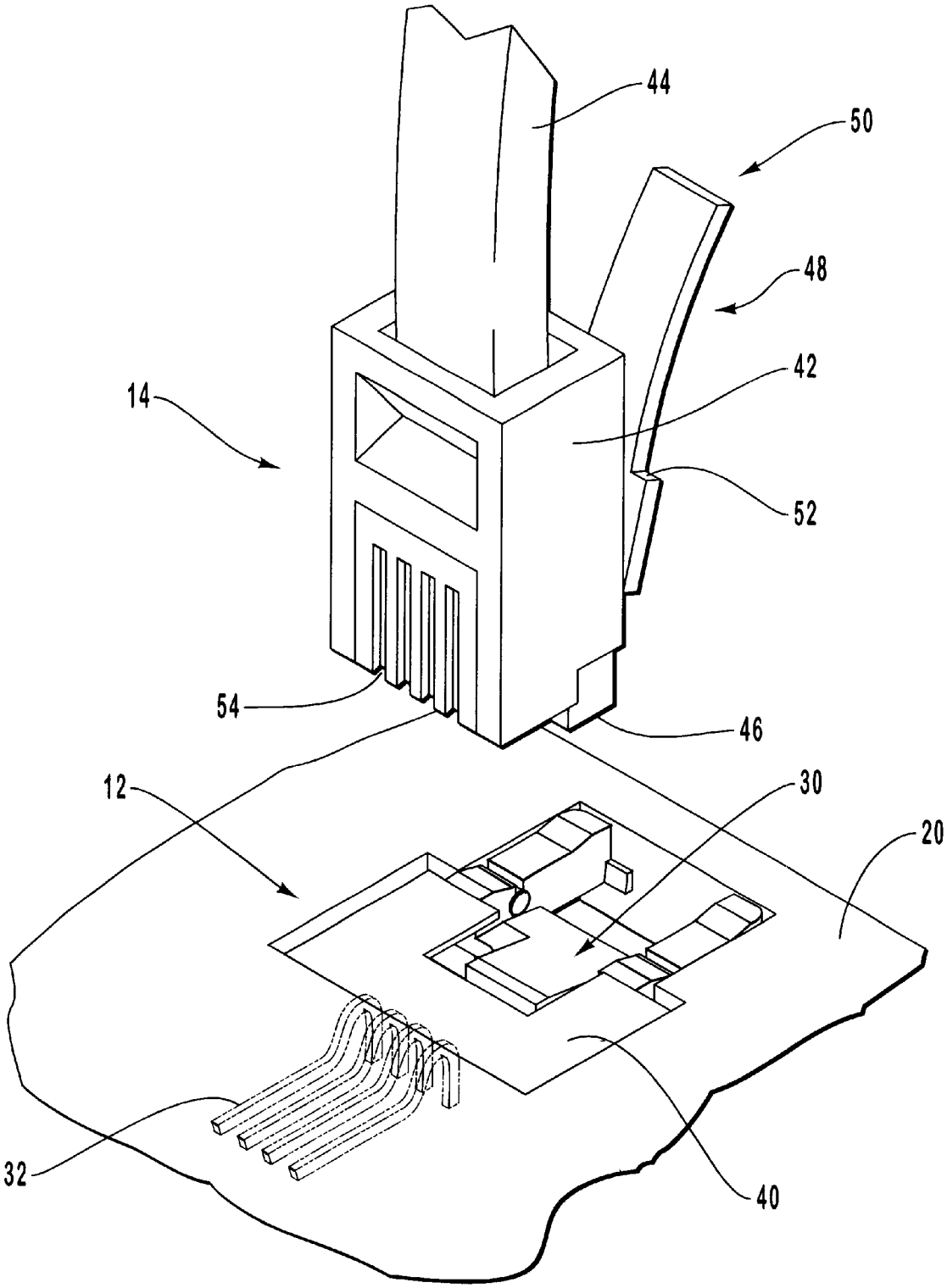
FIG. 2 illustrates a perspective view of one presently preferred embodiment of the modular jack of the present invention that includes a frame, a rocker arm, electrical contacts, and a retractable cover guard.

In FIG. 2, the modular jack 12 of the present invention is shown, comprising a frame 20, a rocker arm 30, electrical contacts 32, and a retractable cover guard 40. A media plug 14 is also depicted, comprising a small block shaped plug body 42 coupled with a cable 44, such as a telephone line. The plug body 42 has a plug nose 46 and a flexible retention clip 48 that is mounted on the plug nose 46 and protrudes away from the plug body 42 at a slight angle, terminating at a narrow free end 50. The retention clip 48 has retention notches 52 that define the edges where the retention clip 48 significantly narrows. Housed within the plug body 42 are distinct contact pins 54. Each of the contact pins 54 are attached to discrete wires within the cable 44. During use, the contact pins 54 of the media plug 14 are biased against the electrical contacts 32 of the modular jack 12, thereby effecting electrical communication between the media plug 14 and the electrical apparatus 10.

The frame 20 of the modular jack 12 is integrated with the electrical apparatus 10, meaning the frame 20 is attached to the chassis of the electrical apparatus 10. It should be appreciated, however, that the modular jack 12 of the present invention can be modified so that the frame 20 is not attached to the chassis of the electrical apparatus 10, but rather attached to a peripheral device that is removably connected to the electrical apparatus 10. The modular jack 12 may also be removably connected to an electrical apparatus 10, independent of any peripheral device.

Figure 3:
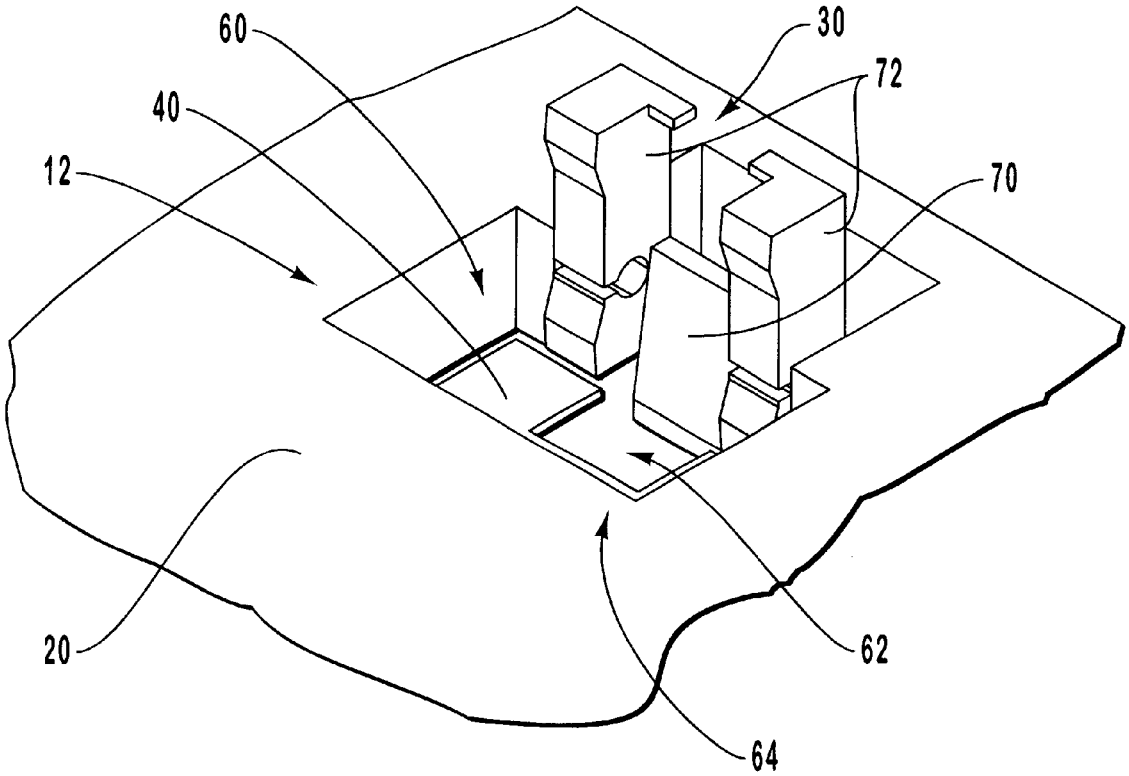
FIG. 3 is a perspective view of one presently preferred embodiment of the modular jack of the present invention that includes a retractable cover guard in a retracted position and a rocker arm in an erect position.

The frame 20 has a aperture 60 and a floor 62, as shown in FIG. 3. The aperture 60 is configured to receive the body 42 of a media plug 14 and extends from the top side 64 of the frame 20 to the floor 62. This means the body 42 of a media plug 14 can be inserted into the aperture 60, but it does not mean that the aperture 60 must necessarily receive the entire body 42 of the media plug 14. In one presently preferred embodiment, the aperture 60 is sufficiently wide to accommodate both RJ-11 series media plugs 14 and RJ-45 series media plugs 14. This is a useful feature for reasons that will be addressed throughout.

The floor 62 is configured for stopping the body 42 of the media plug 14 from passing completely through the aperture 60 of the frame 20. The insertion depth of the media plug 14 can be controlled by the location of the floor 62. One function of the floor 62 is to prevent dust and debris from passing through the modular jack 12 and accumulating on electrical components of the electrical apparatus 10. In one presently preferred embodiment, the floor 62 is flat. However, it should be appreciated that the floor 62 can be modified to accommodate various shapes without departing from the spirit of the present invention.

As shown in FIG. 3, the rocker arm 30 is standing erect. This is the position the rocker arm 30 assumes when a media plug 14 is inserted into the aperture 60 of the frame 20. The rocker arm 30 comprises a base 70 and alignment arms 72. The base 70 is configured for receiving a contact force from the media plug 14 that is generated when the media plug 14 is inserted into the aperture 60 of the frame 20.

Figure 4:
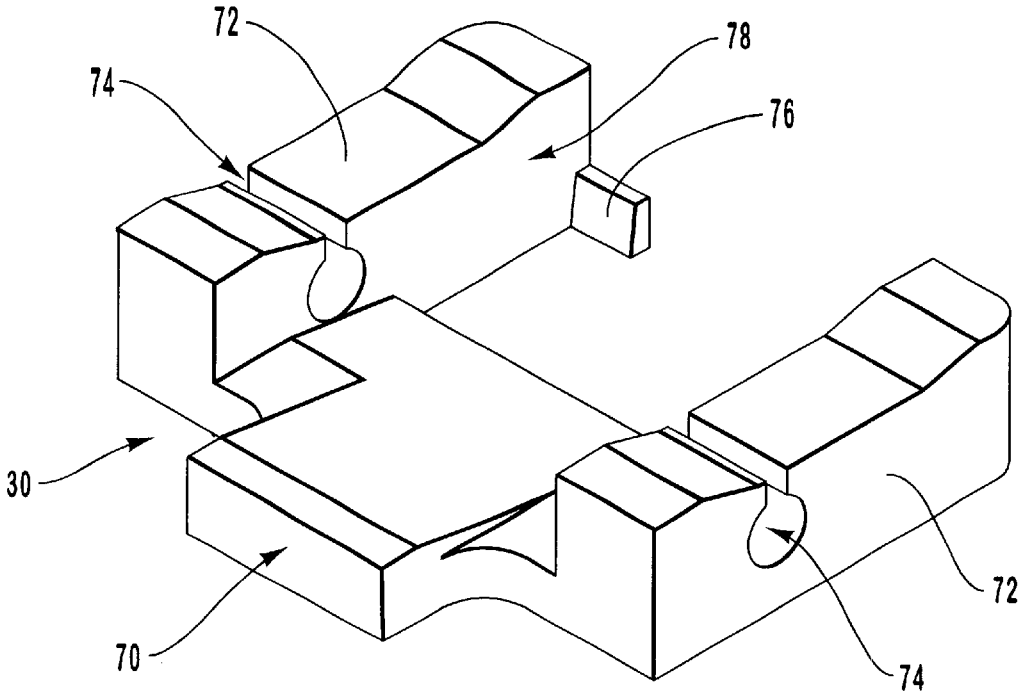
FIG. 4 illustrates a perspective view of one presently preferred embodiment of the rocker arm of the present invention.

As shown in FIG. 4, each of the alignment arms 72 comprises a mounting component 74 for pivotally mounting the rocker arm 30 to the frame 20. The mounting component 74 may comprise any suitable means for pivotally mounting the rocker arm 30 to the frame 20. By way of example and not limitation, the mounting component 74 may comprise a recess that is configured for receiving a pin or other component that is attached to the frame 20 and allows the rocker arm 30 to pivot. The rocker arm 30 also comprises locking ears 76 that are configured to latch onto the retention clip 48 by mechanically latching onto the retention notches 52 of the retention clip 48 when the media plug 14 is inserted into the aperture 60 of the frame 20.

Figure 5:
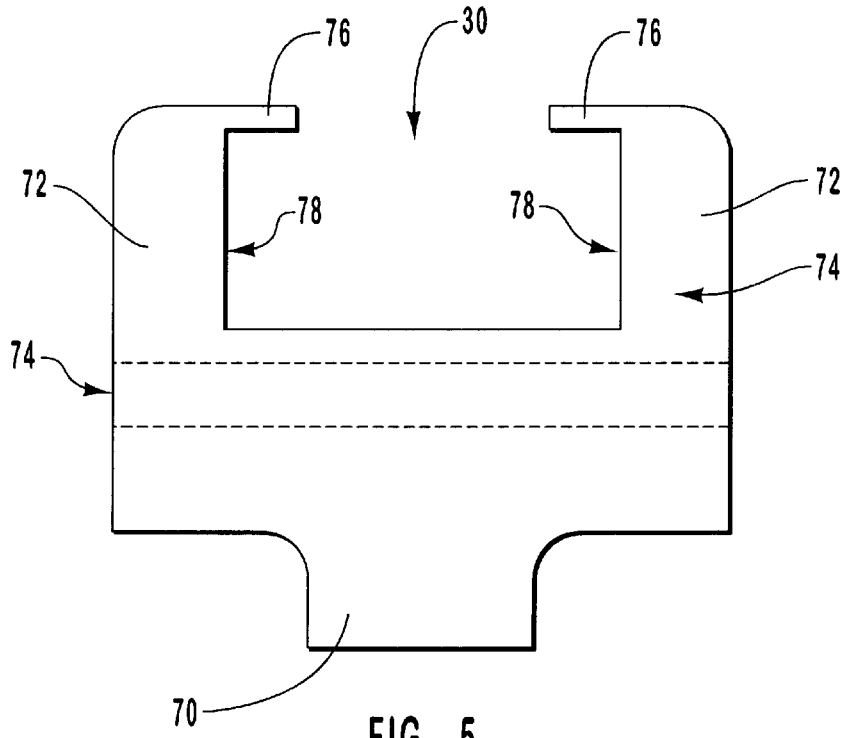
FIG. 5 illustrates a bottom view of one presently preferred embodiment of the rocker arm of the present invention.

The alignment arms 72 have alignment surfaces 78 (FIG. 5) that are configured to slidably engage the sides of the retention clip 48 of the media plug 14 when the media plug 14 is inserted into the aperture 60 of the frame 20. In practice, the alignment arms 72 align the media plug 14 within the aperture 60, even if the right and left sides of the media plug 14 are not in contact with the frame 20. It should be appreciated by one skilled in the art that this is one advantage of the present invention over the prior art because it assures a solid and secure physical connection between the media plug 14 and the modular jack 12 even when the aperture 60 is wider than the body 42 of the media plug 14. In particular, it prevents the media plug 14 from being wiggled back and forth in such a way as to disrupt the interface between the electrical contacts 32 of the modular jack 12 and the contact pins 54 of the media plug 14.

Having the alignment arms 72 configured to slidably engage the retention clip 48 is also useful because it allows a single modular jack 12 to accommodate various media plugs 14 having different body 42 widths, so long as the width of the retention clip 48 is the same for each of the various media plugs 14. This is the case for RJ-11 and RJ-45 series plugs. Even though the body 42 of an RJ-45 series plug is wider than that of an RJ-11 series plug, both RJ-11 and RJ-45 series plugs can be securely coupled with the same modular jack 12 of the present invention, regardless of the width of the aperture 60. This is particularly useful because it enables a single modular jack 12 to act as an interface for both the Internet and LANs.

Figure 6:
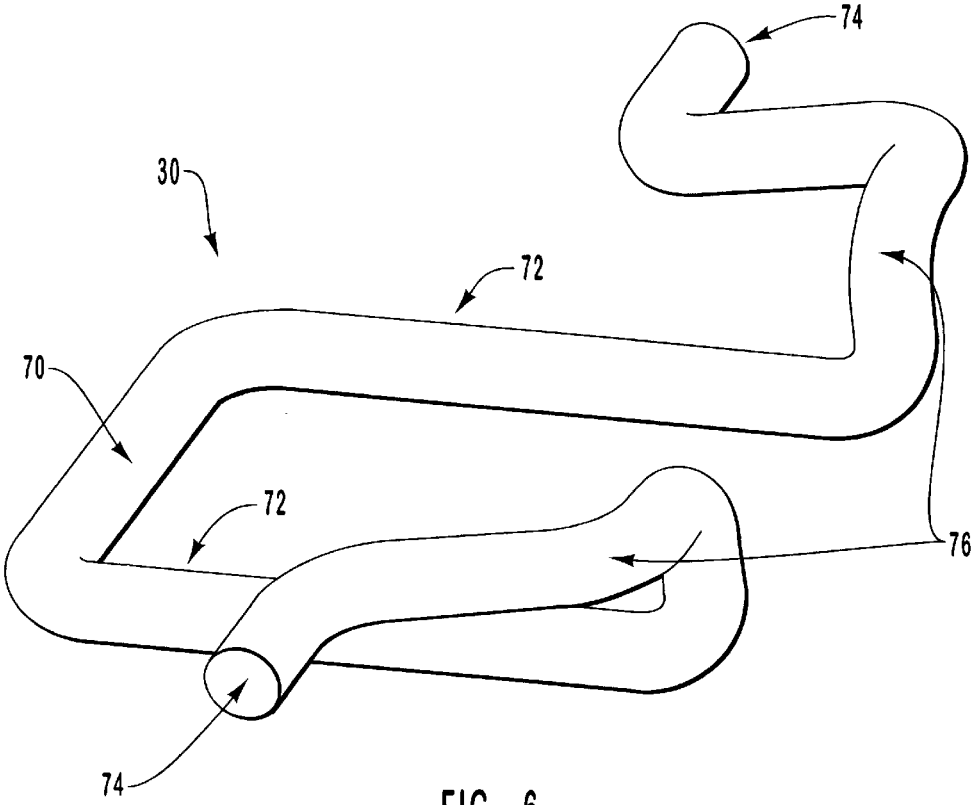
FIG. 6 illustrates a perspective side view of one alternative embodiment of the rocker arm of the present invention.

FIG. 6 illustrates one alternative embodiment of the rocker arm 30 of the present invention. In this embodiment, the base 70, the mounting components 74, the alignment arms 72, and the locking ears 76 are each defined as sections along a single shaped wire having a uniform diameter. The ends of the wire embody the mounting components 74 for pivotally mounting the rocker arm 30 to recesses that can be formed in the frame 20 of the modular jack 12. One advantage of this embodiment is the relatively inexpensive manufacturing costs. Another advantage is that the rocker arm 30 can be easily removed and replaced if it becomes damaged. This functionality is particularly advantageous because it allows the rocker arm 30 to be snapped out of its mounting in the frame 20 without damaging the frame 20 when an unintentional or destructive force is applied to the rocker arm 30.

Figure 7:
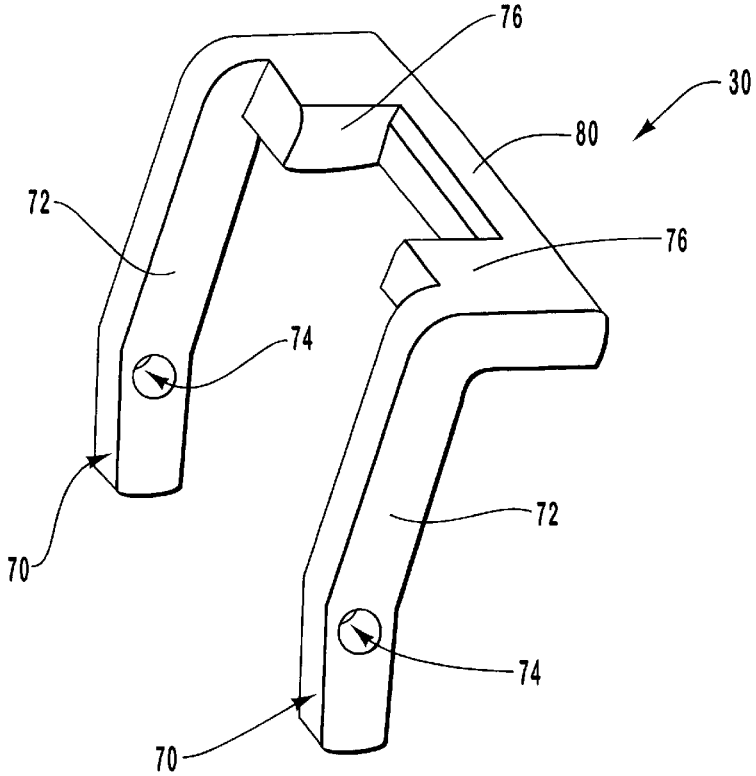
FIG. 7 illustrates a perspective side view of another alternative embodiment of the rocker arm of the present invention.

FIG. 7 illustrates another embodiment of the rocker arm 30 of the present invention. In this embodiment, a tiebar 80 joins the alignment arms 72 and advantageously provides additional stability to the alignment arms 72. As shown, mounting components 74 are configured as holes extending through the alignment arms 72 and are configured for receiving a pin or other component that can be attached to the frame 20 for pivotally mounting the rocker arm 30 to the frame 20. It should be appreciated that any suitable means for pivotally attaching the rocker arm 30 to the frame 20 can be used.

Figure 10:
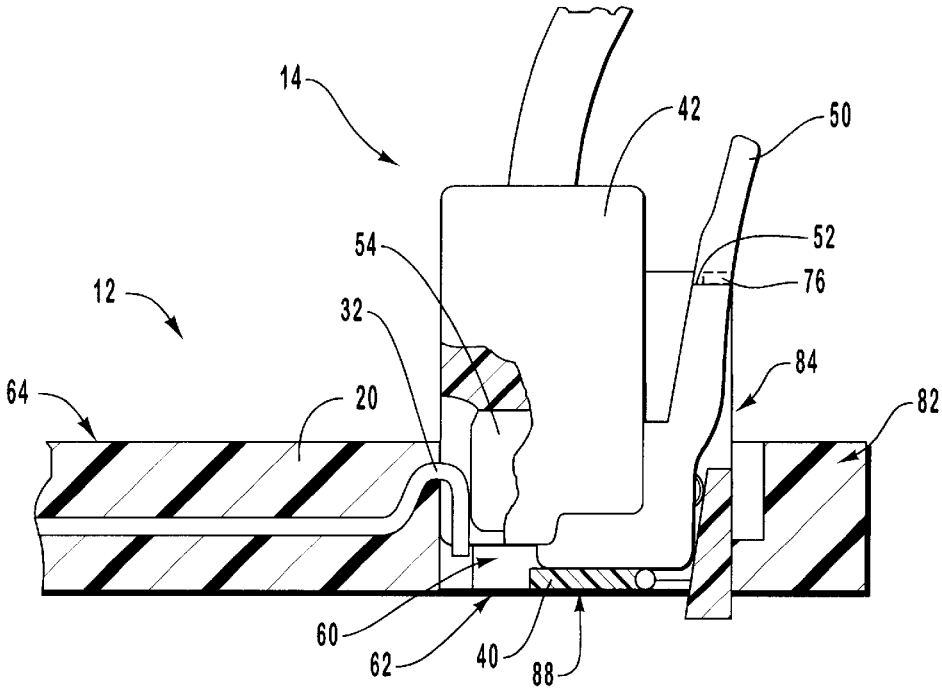
FIG. 10 illustrates a partial cross-sectional side view of a physical/electrical media plug engaging one presently preferred embodiment of the modular jack of the present invention that includes having a retractable cover guard pivotally attached to the base of the rocker arm.

Each of the embodiments of the rocker arm 30 described above have several features in common. They each have, for example, mounting components 74 for pivotally mounting the rocker arm 30 to the frame 20. They also each have a base 70 that is configured for receiving a contact force from a media plug 14. When the base 70 of the rocker arm 30 receives a contact force, the rocker arm 30 is pivoted about an axis that extends between the mounting components 74 of the rocker arm 30 from a first position 82 to a second position 84. In the first position 82, alignment arms 72 of the rocker arm 30 are substantially parallel to the top of the frame 20, as shown. In the second position 84, the alignment arms 72 are substantially perpendicular to the frame 20 and slidably engage the retention clip 48 of the media plug 14. (FIG. 10). This aligns the body 42 of the media plug 14 within the aperture 60 of the frame 20, irrespective of the width of the media plug 14.

Figure 8:
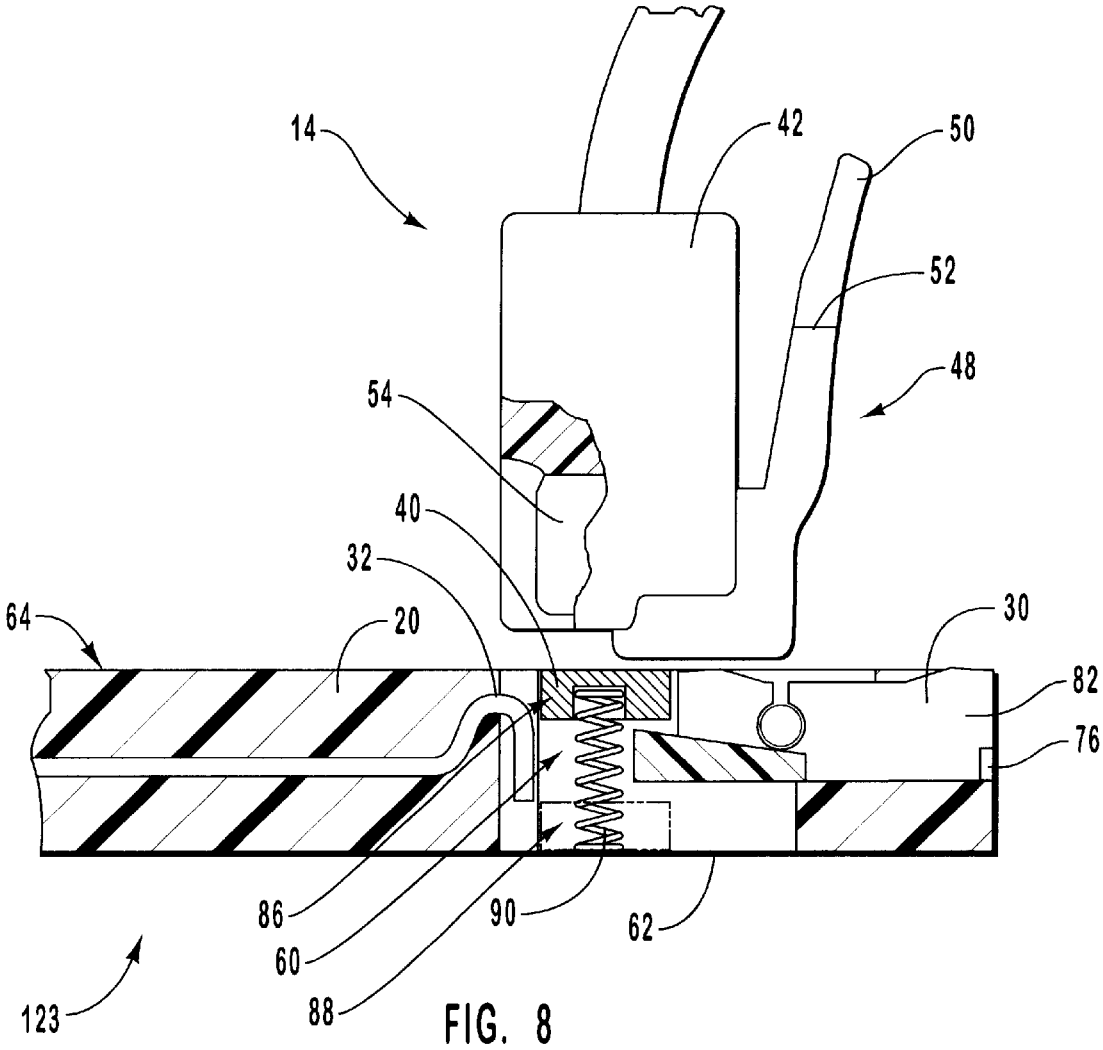
FIG. 8 illustrates a partial cross-sectional side view of a physical/electrical media plug in position to engage one presently preferred embodiment of the modular jack of the present invention that includes having a retractable cover guard retractably attached to the floor of the frame.

FIG. 8 illustrates a partial cross-sectional view of a media plug 14 and one presently preferred embodiment of the modular jack 12 of the present invention. As shown, the media plug 14 is positioned above the modular jack 12 and is ready to be inserted into the aperture 60 of the frame 20. Also shown, is one presently preferred embodiment of the retractable cover guard 40 of the present invention. The retractable cover guard 40 keeps dust and debris from settling in the aperture 60 of the frame 20 and from accumulating on the electrical contacts 32 during nonuse. Another benefit of the retractable cover guard 40 is that it provides an aesthetic surface for displaying printed information, such as icons. This is useful because it frees up the clutter of icons and symbols on the exterior surfaces of the electronic apparatus.

During use, when a media plug 14 is inserted into the aperture 60 of the frame 20, a contact force is applied to the retractable cover guard 40. The retractable cover guard40, upon receiving a contact force from the media plug 14, moves from a first position 86 to a second position 88. The first position 86 is a protective position 86 in which the retractable cover guard 40 covers the aperture 60 of the frame 20 and protects the electrical contacts 32 of the modular jack 12, during nonuse, from debris and ancillary damage. In some embodiments, described below, the retractable cover guard 40 also covers and protects the rocker arm 30.

When the retractable cover guard 40 is moved into the second position 88, also called the retracted position 88, the aperture 60 of the frame 20 and the electrical contacts 32 are exposed to the media plug 14, enabling the media plug 14 to be coupled with the modular jack 12. There are several embodiments of the retractable cover guard 40, each having a different mode of retracting from the protective position to the retracted position 88. In one presently preferred embodiment, the retractable cover guard 40 is retractably attached to the floor 62 of the frame 20. By way of example and not limitation, the means for attaching the retractable cover guard 40 to the floor 62 is a compression spring 90 that constantly urges the retractable cover guard 40 into the protective position 86.

When a media plug 14 is coupled with the modular jack 12 of this embodiment, the retractable cover guard 40 is forced downward to the floor 62 into the retracted position 88, as shown. The insertion depth of the media plug 14 is limited by the floor 62 of the frame 20. The media plug 14 is secured within the aperture 60 when the rocker arm 30 pivots from a first position 82 to a second position 84 (FIG. 10), causing the locking ears 76 of the rocker arm 30 to mechanically latch onto the retention notches 52 of the retention clip 48. To remove the media plug 14 from the aperture 60, the narrow free end 50 of the retention clip 48 is flexed towards the body 42 of the media plug 14. This allows the retention clip 48 to slip past the locking ears 76, enabling the media plug 14 to be removed. When the media plug 14 is removed, the compressed spring forces the retractable cover guard 40 back into the protective position 86.

Figure 9:
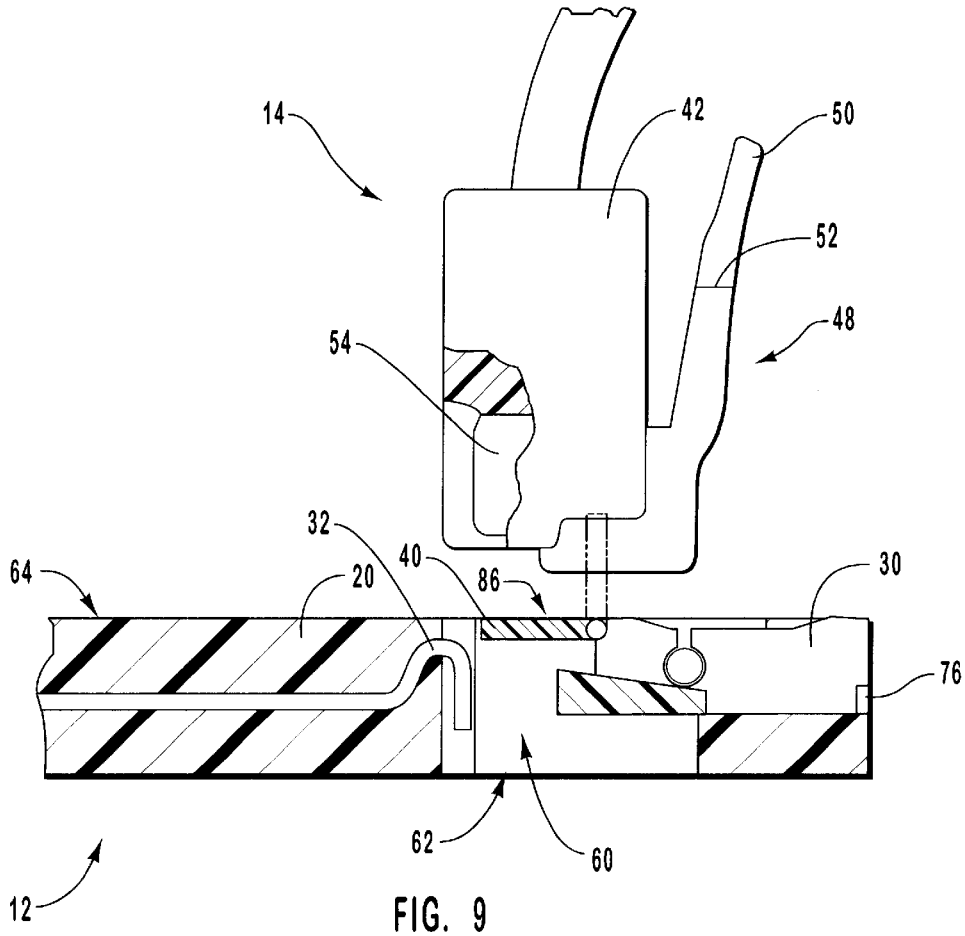
FIG. 9 illustrates a partial cross-sectional side view of a physical/electrical media plug in position to engage one presently preferred embodiment of the modular jack of the present invention that includes having a retractable cover guard pivotally attached to the base of the rocker arm.

Depicted in FIGS. 9 and 10 is an alternative embodiment of the retractable cover guard 40 of the present invention. As shown, the retractable cover guard 40 is pivotally attached to the base 70 of the rocker arm 30 and extends across the aperture 60 of the frame 20. During use, a media plug 14 is inserted into the aperture 60 of the frame 20, generating a contact force that is applied to the rocker arm 30 causing the rocker arm 30 to pivot from a first position 82 to a second position 84.

FIG. 9 illustrates the rocker arm 30 in the first position 82, having alignment arms 72 substantially parallel to the top side 64 of the frame 20. In the second position 84, the retracted position, shown in FIG. 10, the alignment arms 72 of the rocker arm 30 are substantially perpendicular to the top side 64 of the frame 20. As the rocker arm 30 pivots to the second position 84, the retractable cover guard 40 is dragged across the floor 62, causing the retractable cover guard 40 to pivot about an axis of attachment 92 between the retractable cover guard 40 and the rocker arm 30. FIG. 9 illustrates how the retractable cover guard 40 pivots with respect to the rocker arm 30 from a first position 86 to a second position 88. FIG. 10 illustrates the retractable cover guard 40 in the retracted position 88. As shown, the retractable cover guard 40 rests planarly between the floor 62 and the media plug 14. It should be appreciated that the floor 62 limits the insertion depth of the media plug 14 by preventing the body 42 of the media plug 14 from passing completely through the floor 62. The retractable cover guard 40 acts as a spacer between the media plug 14 and the floor 62. The insertion depth of the media plug 14 can be controlled by altering the position of the floor 62 or by altering the thickness of the retractable guard cover.

Even though the insertion depth of the media plug 14 is very limited and shallow, the media plug 14 is securely held in alignment within the aperture 60 by the alignment arms 72 and locking ears 76 of the rocker arm 30. The alignment arms 72 slidably engage the retention clip 48 of the media plug 14, providing alignment for the media plug 14 while the locking ears 76 latch onto the retention notches 52 of the retention clip 48, mechanically securing the media plug 14 within the aperture 60. To remove the media plug 14 from the aperture 60, the narrow free end 50 of the retention clip 48 is flexed towards the body 42 of the media plug 14. This allows the retention clip 48 to slip past the locking ears 76, enabling the media plug 14 to be removed.

When the media plug 14 is removed from the aperture 60, the rocker arm 30 and the retractable cover guard 40 are returned to their previous positions 82 and 86 (FIG. 9), either automatically or manually. By way of example and not limitation, a spring may be attached to the rocker arm 30 at the mounting components 74, constantly urging the rocker arm 30 into the horizontal position. A spring may also be attached to the retractable cover guard 40 at the point of attachment to the rocker arm 30, constantly urging the retractable cover guard 40 into the protective position 86.

FIG. 10 illustrates how an electrical communication between the media plug 14 and the electrical apparatus 10 is effectuated. When a media plug 14 is inserted into the aperture 60, the contact pins 54 of the media plug 14 are bias against the electrical contacts 32 of the modular jack 12, that are exposed to the aperture 60 but do not extend into the aperture 60. This enables the electrical apparatus 10 to receive transmissions that are sent through the media plug 14.

Figure 11:
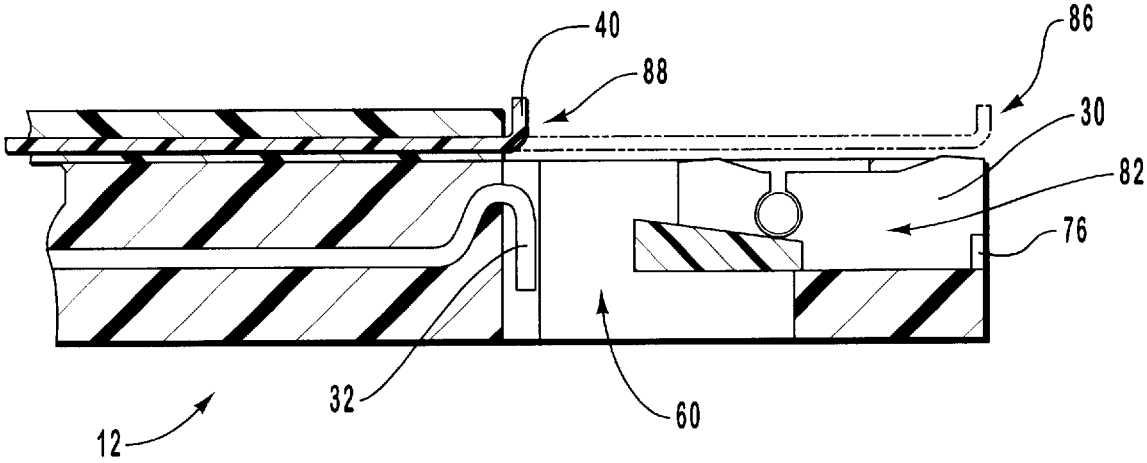
FIG. 11 illustrates a partial cross-sectional side view of one presently preferred embodiment of the modular jack of the present invention that includes having a retractable cover guard slidably attached to the top side of the frame.

FIG. 11 depicts an alternative embodiment of the retractable cover guard 40 of the present invention. In this embodiment, the retractable cover guard 40 is slidably attached to the top side 64 of the frame 20 and retractably covers the entire aperture 60 of the frame 20 and the rocker arm 30. However, it should be appreciated that the retractable cover guard 40 may be modified to cover only selective portions of the aperture 60 and the rocker arm 30. Before a media plug 14 is inserted into the aperture 60 of the present embodiment, the retractable cover guard 40 is manually slid away from the protective position 86 to the retracted position 88, as shown. After use, the media plug 14 is removed and the retractable cover guard 40 is returned to its protective position 86 either manually or automatically. By way of example, and not limitation, a spring may provide the means for automatically returning the retractable cover guard 40 to the protective position 86 after the media plug 14 is removed.

Figure 12:
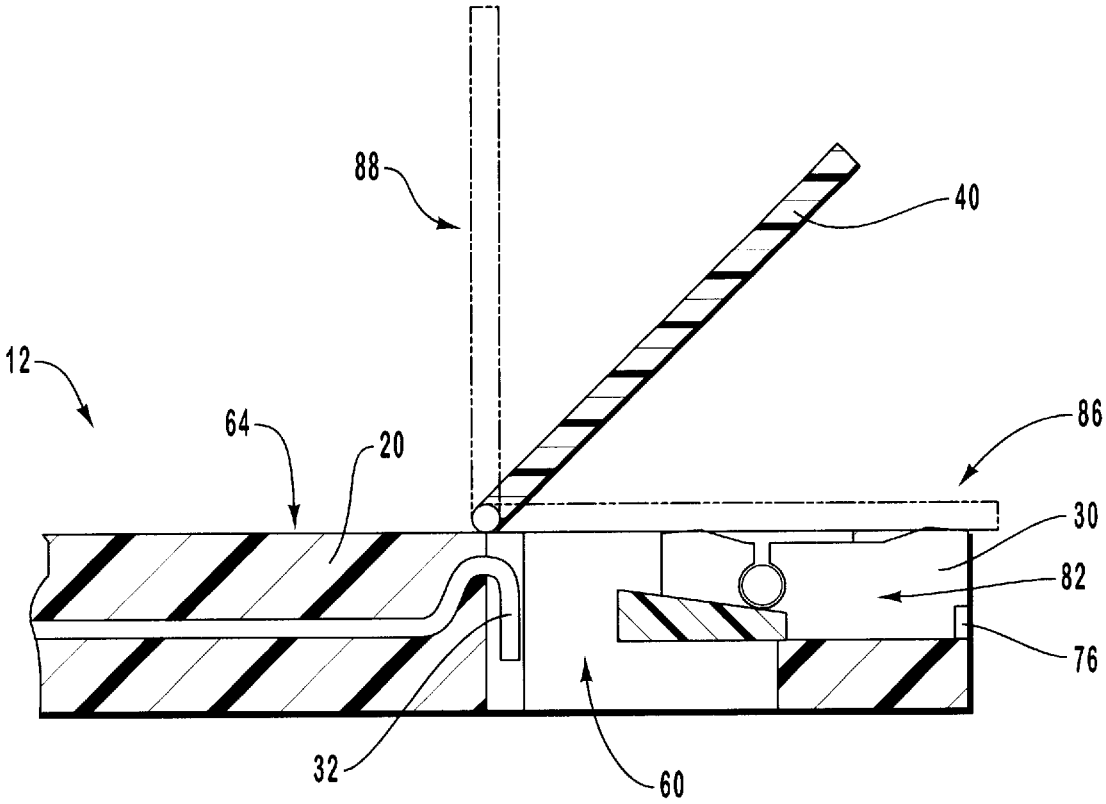
FIG. 12 illustrates a partial cross-sectional side view of one presently preferred embodiment of the modular jack of the present invention that includes having a retractable cover guard pivotally attached to the top side of the frame.

FIG. 12 illustrates another embodiment of the present invention that includes a retractable cover guard 40 that is pivotally attached to the top side 64 of the frame 20 and covers the entire aperture 60 and the rocker arm 30. In this embodiment, the retractable cover guard 40 is manually pivoted up and away from the aperture 60 of the modular jack 12 from a protective position 86 to a retracted position 88. Although the retracted position is shown to be perpendicular to the top side 64 of the frame 20, this should only be construed as illustrative and not limiting. The retracted position 88 may be any position that enables the media plug 14 to be freely inserted into the aperture 60 of the frame 20. It should also be appreciated that the retractable cover guard 40 can be attached to various portions and various sides of the frame 20 without departing from the spirit of the present invention. After use, when a media plug 14 is removed from the aperture 60, the retractable cover guard 40 is returned to the protective position 86 either manually or automatically. By way of example and not limitation, a spring is one suitable means for automatically returning the retractable cover guard 40 to the protective position 86.

Figure 13:
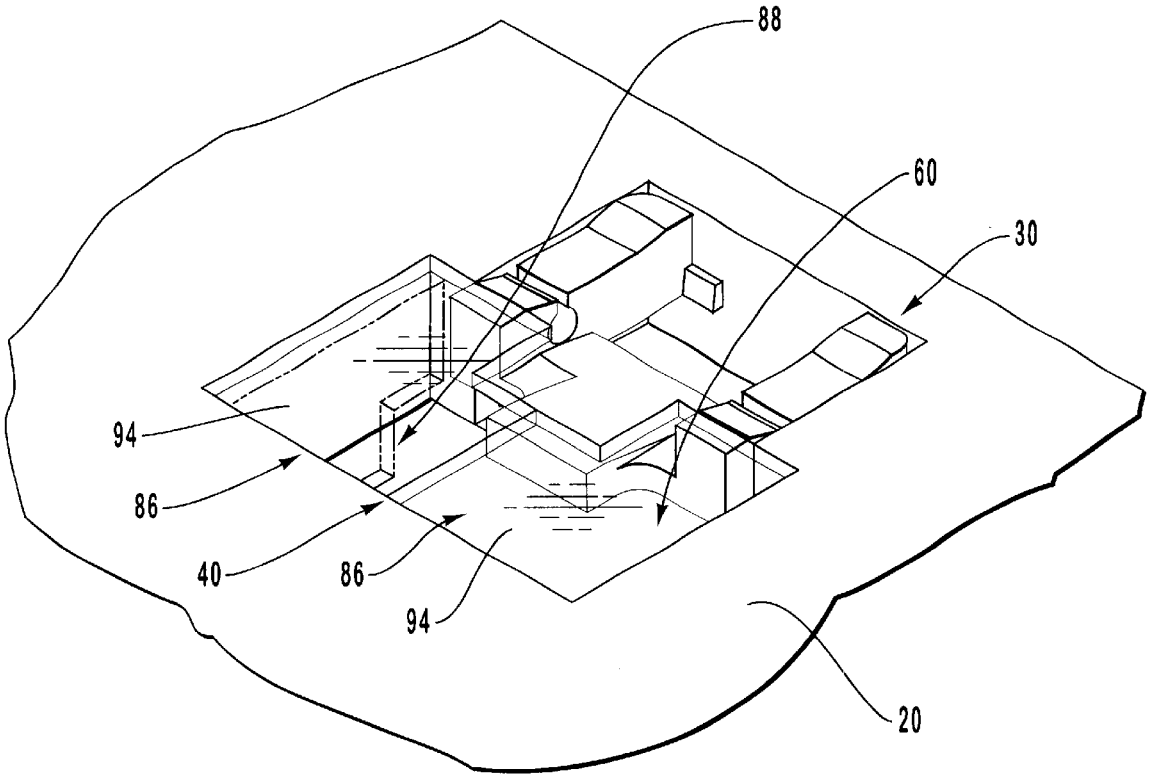
FIG. 13 illustrates a top view of one presently preferred embodiment of the modular jack of the present invention that includes having a retractable cover guard, comprising two doors, pivotally attached to the top side of the frame.

FIG. 13 depicts yet another embodiment, in which the retractable cover guard 40 arm is pivotally attached to the top side 64 of the frame 20. In this embodiment, the retractable cover guard 40 covers only the aperture 60 and comprises two doors 94 that are automatically retracted into the aperture 60 when a media plug 14 is inserted into the aperture 60. However, it should be appreciated that the retractable cover guard 40 of the present invention may be modified to comprise a single door 94 or multiple doors 94 having different shapes without departing from the spirit of the present invention. After use, when the media plug 14 is removed from the aperture 60, the retractable cover guard 40 is automatically returned to the protective position 86 by any suitable means, including but not limited to springs.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus that allows a media plug to be physically and electrically connected to an electrical apparatus, the media plug including a body and a retention clip, the apparatus comprising:

a frame including an upper surface and a lower surface;

an opening located in the upper surface of the frame, the opening being sized and configured to receive at least a portion of the media plug;

a rocker arm pivotally attached to the frame, the rocker arm comprising:

a base that is sized and configured to engage the media plug when the media plug is inserted into the opening, the engagement of the media plug with the base causing the rocker arm to pivot relative to the frame;

first and second alignment arms extending from the base, the first and second alignment arms including alignment surfaces that are sized and configured to slidably engage the retention clip of the media plug; and a retractable cover guard that is sized and configured to cover at least a portion of the opening in the frame, the retractable cover guard movable between a first position in which at least a portion of the opening is covered and a second position in which at least a portion of the opening is exposed to allow the media plug to be inserted into the opening.

2. The apparatus as in claim 1, wherein the engagement of the media plug with the retractable cover guard when the media plug is being inserted into the opening causes the retractable cover guard to move from the first position to the second position.

3. The apparatus as in claim 1, further comprising a storage position for the rocker arm when the media plug is not inserted into the opening and a use position in which at least a portion of the media plug is inserted into the opening.

4. The apparatus as in claim 1, further comprising one or more locking ears extending from the first and second alignment arms of the rocker arm, the locking ears being sized and configured to secure the media plug in a fixed location.

5. The apparatus as in claim 1, further comprising one or more mounting components that pivotally attach the rocker arm to the frame.

6. The apparatus as in claim 1, wherein the opening only extends through the upper surface of the frame and not through the lower surface of the frame.

7. The apparatus as in claim 1, wherein the retractable cover guard is pivotally attached to the base of the rocker arm.

8. The apparatus as in claim 1, wherein the retractable cover guard is connected to the frame by a spring.

9. The apparatus as in claim 1, wherein the retractable cover guard is slidably connected to the frame.

10. The apparatus as in claim 1, wherein the retractable cover guard is pivotally attached to the upper surface of the frame.

11. The apparatus as in claim 1, wherein the retractable cover guard includes one or more doors that are pivotally attached to the frame.

12. The apparatus as in claim 1, wherein the opening in the upper surface of the frame is larger than the width of the media plug.

13. The apparatus as in claim 1, wherein the opening in the upper surface of the frame is sized and configured to receive either an RJ-11 or an RJ-45 type media plug.

14. The apparatus as in claim 1, wherein the opening in the upper surface of the frame is sized and configured to receive an RJ-11 type media plug, and wherein neither a first side nor a second side of the RJ-11 type media plug engage either a first side or a second side of the opening in the frame.

15. The apparatus as in claim 1, further comprising a slot formed in the electrical apparatus, the frame being slidably retractable into the slot between a first position in which the frame is completely or generally disposed within the electrical apparatus and a second position in which the frame is generally disposed outside of the electrical apparatus.

16. The apparatus as in claim 1, wherein the retractable cover guard retracts from the first position to the second position upon receiving a contact force caused by the media plug being inserted into the opening in the frame.

17. The apparatus as in claim 16, wherein the retractable cover guard automatically returns to the first position when the media plug is removed from the opening in the frame.

18. A communications device for coupling with a RJ-series connector plug, the RJ-series connector plug including a body and a retention clip, the communications device comprising:

a body;

a retractable connector attached to the body, the retractable connector including an upper surface and a lower surface;

an opening formed in the upper surface of the retractable connector that is sized and configured to receive at least a portion of the RJ-series connector plug, the retractable connector movable between a storage position in which the retractable connector is completely or generally disposed within the communications device and a use position in which the retractable connector is generally disposed outside of the communications device;

a rocker arm pivotally attached to the retractable connector, the rocker arm comprising:

a base that is sized and configured to engage the RJ-series connector plug when the RJ-series connector plug is inserted into the opening, the engagement of the RJ-series connector plug with the base causing the rocker arm to pivot relative to the retractable connector;

first and second alignment arms extending from the base, the first and second alignment arms including alignment surfaces that are sized and configured to slidably engage the retention clip of the RJ-series connector plug; and a retractable cover guard that is sized and configured to cover at least a portion of the opening in the frame, the retractable cover guard movable between a first position in which at least a portion of the opening is covered and a second position in which at least a portion of the opening is exposed to allow the RJ-series connector plug to be inserted into the opening.

19. The communications device as in claim 18, wherein the engagement of the media plug with the retractable cover guard when the media plug is being inserted into the opening causes the retractable cover guard to move from the first position to the second position.

20. The communications device as in claim 18, further comprising a storage position for the rocker arm when the RJ-series connector plug is not inserted into the opening and a use position in which at least a portion of the RJ-series connector plug is inserted into the opening.

21. The communications device as in claim 18, further comprising one or more locking ears extending from the first and second alignment arms of the rocker arm, the locking ears being sized and configured to secure the RJ-series connector plug in a fixed location.

22. The communications device as in claim 18, further comprising one or more mounting components that pivotally attach the rocker arm to the frame.

23. The communications device as in claim 18, wherein the opening only extends through the upper surface of the frame and not through the lower surface of the frame.

24. The communications device as in claim 18, wherein the retractable cover guard is pivotally attached to the base of the rocker arm.

25. The communications device as in claim 18, wherein the retractable cover guard is connected to the frame by a spring.

26. The communications device as in claim 18, wherein the retractable cover guard is slidably connected to the frame.

27. The communications device as in claim 18, wherein the retractable cover guard is pivotally attached to the upper surface of the frame.

28. The communications device as in claim 18, wherein the retractable cover guard includes one or more doors that are pivotally attached to the frame.

29. The communications device as in claim 18, wherein the opening in the upper surface of the frame is larger than the width of the RJ-series connector plug.

30. The communications device as in claim 18, wherein the opening in the upper surface of the frame is sized and configured to receive either an RJ-11 or an RJ-45 series connector.

31. The communications device as in claim 18, wherein the opening in the upper surface of the frame is sized and configured to receive an RJ-11 series connector, and wherein neither a first side nor a second side of the RJ-11 series connector engage either a first side or a second side of the opening in the frame.

32. The communications device as in claim 18, further comprising a slot formed in the communications device, the frame being slidably retractable into the slot in the storage position and a portion of the frame extending outwardly from the slot in the use position.

33. The communications device as in claim 18, wherein the retractable cover guard retracts from the first position to the second position upon receiving a contact force caused by the RJ-series connector plug being inserted into the opening in the frame.

34. The communications device as in claim 18, wherein the retractable cover guard automatically returns to the first position when the RJ-series connector plug is removed from the opening in the frame.

35. A method of physically and electrically connected a media plug to an electrical apparatus, the media plug including a body and a retention clip, the method comprising:

providing a frame including an upper surface and a lower surface;

providing an opening located in the upper surface of the frame, the opening being sized and configured to receive at least a portion of the media plug;

providing a rocker arm pivotally attached to the frame;

inserting the media plug into the opening in the upper surface of the frame;

engaging the media plug with a base of the rocker arm to cause the rocker arm to pivot relative to the frame while the media plug is being inserted into the opening in the upper surface of the frame; and slidably engaging the retention clip of the media plug with first and second alignment arms extending from the base of the rocker arm.

36. The method of claim 21, further comprising engaging the media plug with a retractable cover guard that covers at least a portion of the opening in the frame, the retractable cover guard moving between a first position in which at least a portion of the opening is covered to a second position to allow the media plug to be inserted into the opening.

37. A method for coupling a RJ-series connector plug to a communications device, the RJ-series connector plug including a body and a retention clip, the method comprising:

providing a communications device with a retractable connector, the retractable connector including an upper surface with an opening that is sized and configured to receive at least a portion of the RJ-series connector plug, the retractable connector movable between a storage position in which the retractable connector is completely or generally disposed within the communications device and a use position in which the retractable connector is generally disposed outside of the communications device;

inserting the RJ-series connector plug into the opening in the retractable connector;

contacting the RJ-series connector plug with a base of a rocker arm that is at least partially disposed within the opening, the contacting of the RJ-series connector plug with the base causing the rocker arm to pivot relative to the retractable connector; and slidably engaging the retention clip of the RJ-series connector plug with first and second alignment arms extending from the base of the rocker arm.

38. The method of claim 37, further comprising engaging the media plug with a retractable cover guard that covers at least a portion of the opening in the retractable connector, the retractable cover guard moving between a first position in which at least a portion of the opening is covered to a second position to allow the RJ-series connector plug to be inserted into the opening.

* * * * *